US005507887A

United States Patent [19]

Uesugi et al.

[11] Patent Number: 5,507,887

[45] Date of Patent: Apr. 16, 1996

[54] SUPPORT FOR PLANOGRAPHIC PRINTING PLATE

[75] Inventors: Akio Uesugi; Tsutomu Kakei, both of Shizuoka, Japan

[73] Assignee: Fuji Photo Film Co., Ltd., Kanagawa, Japan

[21] Appl. No.: 278,949

[22] Filed: Jul. 22, 1994

[30] Foreign Application Priority Data

Jul. 26, 1993 [JP] Japan ..... 5-202548

[51] Int. Cl.[6] ..... C22F 1/04

[52] U.S. Cl. ..... 148/551; 148/692

[58] Field of Search ..... 148/551, 437, 148/692, 416; 164/476, 477

[56] References Cited

U.S. PATENT DOCUMENTS 5,078,805 1/1992 Uesugi et al. ..... 148/692

5,350,010 9/1994 Sawada et al. ..... 148/551

FOREIGN PATENT DOCUMENTS 0581321 7/1993 European Pat. Off. .

*Primary Examiner*—Scott Kastler

*Attorney, Agent, or Firm*—Sughrue, Mion, Zinn, Macpeak & Seas

[57] ABSTRACT

Disclosed is a support for planographic printing plate prepared by a process which comprises subjecting molten aluminum alloy to continuous casting by a twin-roll continuous casting machine to directly caste a plate, subjecting the plate to cold rolling and heat treatment once or more times, respectively, reforming the plate, and then surface graining the plate, wherein crystalline grains on a cross section of the finished plate (a) have an average diameter in circle equivalence of 15 μm to 35 μm, (b) contain those having an average diameter in circle equivalence of not less than 40 μm in a proportion of not more than 30% and (c) assume a shape factor of not less than 4.0.

8 Claims, 2 Drawing Sheets

$$S=\frac{\pi}{4}D^2$$

$$S'=\frac{\pi}{4}L^2$$

SUPPORT FOR PLANOGRAPHIC PRINTING PLATE

FIELD OF THE INVENTION

The present invention relates to a support for planographic printing plate and more particularly to a process for the preparation of an aluminum support which can be well subjected to surface treatment such as electrolytic graining and anodizing and which exhibits small strength drop even when subjected to burning.

BACKGROUND OF THE INVENTION

As an aluminum support for printing plate, particularly for offset printing plate, there is used an aluminum plate (including aluminum alloy plate).

In general, an aluminum plate to be used as a support for offset printing plate needs to have a proper adhesion to a photographic light-sensitive material and a proper water retention.

The surface of the aluminum plate should be uniformly and finely grained to meed the aforesaid requirements. This graining process large affects a printing performance and a durability of the printing plate upon the printing process following manufacture of the plate. Thus, it is important for the manufacture of the plate whether such graining is satisfactory or not.

In general, an alternating current electrolytic graining method is used as the method of graining an aluminum support for a printing plate. There are a variety of suitable alternating currents, for example, a sinewaveform, a square-waveform, a special alternating waveform and the like. When the aluminum support is grained by alternating current supplied between the aluminum plate and an opposite electrode such as a graphite electrode, this graining is usually conducted only one time, as the result of which, the depth of pits formed by the graining is small over the whole surface thereof. Also, the durability of the grained printing plate during printing will deteriorate. Therefore, in order to obtain a uniformly and closely grained aluminum plate satisfying the requirement of a printing plate with deep pits as compared with their diameters, a variety of methods have been proposed as follows.

One method is a graining method to use a current of particular waveform for an electrolytic source (JP-A-53-67507) (The term "JP-A" as used herein means an "unexamined published Japanese patent application".) Another method is to control a ratio between an electricity quantity of a positive period and that of a negative period at the time of alternating electrolytic graining (JP-A-54-65607). Still another method is to control the waveform supplied from electrolytic source (JP-A-55-25381). Finally, another method is directed to a combination of current density (JP-A-56-29699).

Further, known is a graining method using a combination of an AC electrolytic etching method with a mechanical graining method (JP-A-55-142695).

As the method of producing an aluminum support, on the other hand, known is a method in which an aluminum ingot is melted and held, and then cast into a slab (having a thickness in a range from 400 to 600 mm, a width in a range from 1,000 to 2,000 mm, and a length in a range from 2,000 to 6,000 mm). Then, the cast slab thus obtained is subject to a surface-cutting step in which the slab surface is cut off by 3 to 10 mm with a surface cutting machine so as to remove an impurity structure portion on the surface. Next, the slab is subject to a soaking treatment step in which the slab is kept in a holding furnace at a temperature in a range from 480° to 540° C. for a time in a range from 6 to 12 hours, thereby to remove any stress inside the slab and make the structure of the slab uniform. Then, the thus treated slab is hot-rolled at a temperature in a range from 480° to 540° C. to a thickness in a range from 5 to 40 mm. Thereafter, the slab is cold-rolled at the room temperature to a predetermined thickness. Then, in order to make the structure uniform and improve the flatness of the plate, the thus treated slab is annealed thereby to make the rolled structure, etc. uniform, and the slab is then subject to correction by cold-rolling to a predetermined thickness. Such an aluminum plate obtained in the manner as described above has been used as a support for a planographic printing plate.

The present inventors previously proposed the enhancement of yield by continuously performing casting and hot-rolling from molten aluminum to form a hot-rolled coil of a thin plate, transforming the hot-rolled coil into an aluminum support through cold-rolling, heat-treatment and correction, and finally, graining the aluminum support (U.S. Pat. No. 5,078,805 which corresponds to JP-A-3-79798).

However, as a result of study-on the foregoing proposed methods, it was found that the average diameter, diameter distribution and shape of crystalline grains have a great effect on the adaptability to surface treatment and burning.

SUMMARY OF THE INVENTION

An object of the present invention is to provide a support for planographic printing plate having a reduced dispersion of the quality of aluminum support and an improved adaptability to surface treatment such as electrolytic graining and burning.

As a result of extensive studies particularly on aluminum supports, the present inventors have worked out the present invention.

In other words, the foregoing object of the present invention is accomplished with a support for planographic printing plate prepared by a process which comprises subjecting molten aluminum alloy to continuous casting by a twin-roll continuous casting machine to directly cast a plate, subjecting the plate to cold rolling and heat treatment once or more times, respectively, reforming the plate, and then surface graining the plate, wherein crystalline grains on a cross section of the finished plate (a) have an average diameter in circle equivalence of 15 μm to 35 μm, (b) contain those having an average diameter of not less than 40 μm in circle equivalence in a proportion of not more than 30% and (c) assume a shape factor of not less than 4.0.

In a preferred embodiment, the molten aluminum alloy consists of 0.2 to 0.4 wt % of Fe, 0.05 to 0.20 wt % of Si, not more than 0.03 wt % of Cu, not more than 0.04 wt % of Ti based on the total amount of the molten aluminum alloy, and a balance of aluminum and unavoidable impurities.

DETAILED DESCRIPTION OF THE INVENTION

Figure 1A:
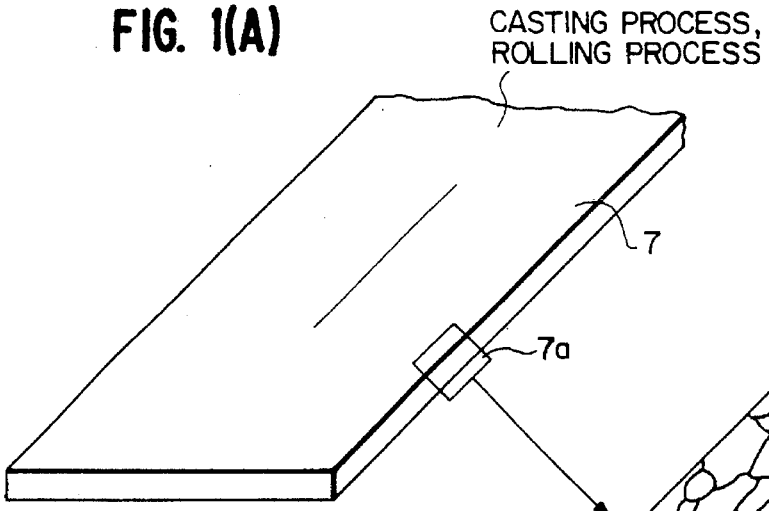
FIGS. 1(A), 1(B), 1(C) and 1(D) illustrate how crystalline grains in the support for planographic printing plate according to the present invention are controlled, in which 7 indicates a continuously casted aluminum, 7*a* indicates a cross section of the finished aluminum plate, 8 indicates a crystalline grain, 8*a* indicates a crystalline interface, 9 indicates a circle having the same area as that of a grain, D indicates a diameter in circle equivalence, L indicates an absolute maximum length, S indicates an area of a crystalline grain, and S' indicates an area of circle having a diameter of L.

As a method for forming a coil of continuously casted aluminum plate from molten aluminum alloy by a twin-roll casting machine, a continuous thin sheet casting technique such as hunter method and 3C method has been put into practical use. In the present invention, when molten aluminum alloy is subjected to continuous casting by a twin-roll casting machine, the diameter of crystalline grains is regulated to a predetermined range, whereby the distribution of alloy components which can easily gather at the interface of crystalline grains can be regulated to a predetermined range. Further, by deforming the grain interface at the pressing or annealing process after continuous casting to disperse alloy components therein, the distribution of alloy components in the finished aluminum plate can be uniform. However, since the effect of crystalline grain interface cannot be fully eliminated, the diameter of crystalline grains in the finished aluminum plate is regulated to a predetermined range. In this manner, a high quality support for planographic printing plate having a high quality surface that can be uniformly grained can be prepared at a low cost in a high yield.

Referring to FIGS. 2(A), 2(B), 2(C) and 2(D) which illustrate the concept of a preparation process, an embodiment of the process for the preparation of an aluminum plate to be used in the present invention will be described in detail. Melting furnace 1 (FIG. 2(A)) in which an aluminum ingot is molten and retained. The molten aluminum alloy is then fed to twin-roll continuous casting machine 2 (FIG. 2(A)). In some detail, molten aluminum alloy may be wound on coiler 6 (FIG. 2(A)) for directly forming a coil of thin sheet from molten aluminum alloy or may be immediately subjected to heat treatment by heat treatment machine 4 (FIG. 2(C)), cold rolling by cold rolling mill 3 (FIG. 2(B)) and reforming by reformer 5 (FIG. 2(D)).

Further referring to the preparation conditions, the temperature in melting furnace 1 needs to be kept at not lower than the melting point of aluminum. The temperature in the melting furnace varies properly depending on the components of aluminum alloy. In general, it is not lower than 700° C.

In order to inhibit the production of oxides of molten aluminum alloy and remove alkaline metals which impair the quality of the aluminum plate, the molten aluminum alloy is subjected to proper treatment such as inert gas purge and fluxing.

The molten aluminum alloy thus treated is subsequently subjected to casting by twin-roll continuous casting machine 2. There are many casting methods. In most cases, hunter method, 3C method, etc. are industrially operated.

The optimum casting temperature is in the vicinity of 700° C., though depending on the cooling conditions of the casting mold. The crystalline grain diameter and cooling conditions after continuous casting, the casting speed, and the change of the thickness of the plate during casting are controlled. The plate obtained by continuous casting is then rolled to a predetermined thickness by means of cold rolling mill 3. Thereafter, the plate is reformed by reformer 5 so that it is provided with a predetermined smoothness to prepare an aluminum support which is then grained. The reforming may be included in the final cold rolling. If necessary, heat treatment may be conducted with heat treatment apparatus 4 before the adjustment of the final thickness in cold rolling mill 3. A heat treatment apparatus may be a continuous system (as shown in FIG. 2(C)) or a batch system.

The crystalline grains are adjusted such that crystalline grains in a cross section of the finished plate thus casted and rolled (a) have an average diameter in circle equivalence of 15 μm to 35 μm, preferably 15 μm to 30 μm, more preferably 17 μm to 22 μm, (b) comprise those having a diameter of not less than 40 μm in circle equivalence in a proportion of not more than 30%, preferably 10 to 25%, more preferably 15 to 20% and (c) assume a shape factor of not less than 4.0, preferably not less than 4.4, more preferably not less than 4.8.

Figure 1B:
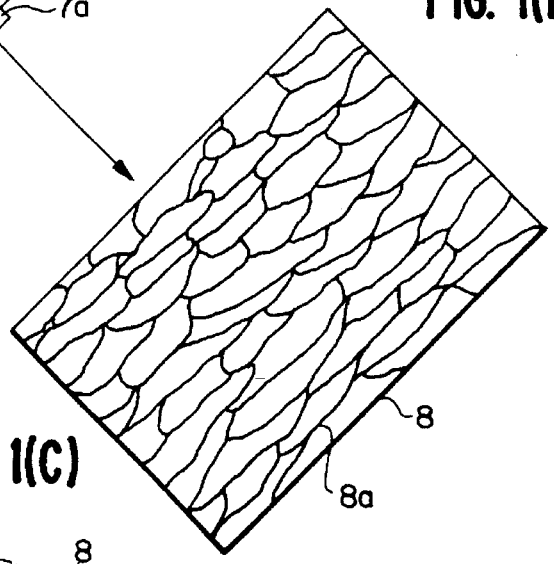
Figure 1C:
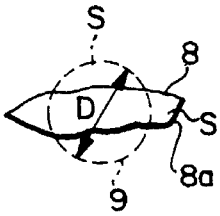
Figure 1D:
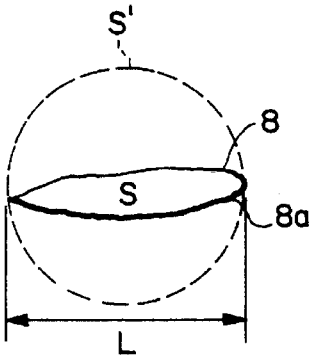

FIG. 1(A) illustrates a cross-section (7*a*) of the finished plate and FIG. 1(B) illustrates an enlarged view of the cross section (8*a*). The average diameter in circle equivalence (E) is the average of the diameter (D) of circles having the same area as area (S) of crystalline grains. D is calculated from the equation $D=(4/\pi\times S)^{1/2}$. The shape factor indicates the degree of roundness calculated from the equation $(\pi L^2/4)/(\pi E^2/4)=S'/S$=(area of circle having the same diameter as the longest side L of crystal (see FIG. 1(D))/(area of circle having the same diameter as the diameter E of crystal in circle equivalence (see FIG. 1(C)). In some detail, if the crystal is completely round, its shape factor is 1. The longer the crystal is, the more its shape factor exceeds 1.

The molten aluminum alloy preferably comprises 0.2 to 0.4 wt % of Fe, 0.05 to 0.20 wt % of Si, not more than 0.03 wt % of Cu, and not more than 0.04 wt % of Ti based on the total amount of the molten aluminum alloy.

As the method for graining the support for planographic printing plate according to the present invention, there include mechanical graining, chemical graining, electrochemical graining or combination thereof.

Examples of mechanical graining methods include ball graining, wire graining, brush graining, and liquid honing. As electrochemical graining method, there is normally used AC electrolytic etching method. As electric current, there include a normal alternating current such as sinewaveform or a special alternating current such as squarewaveform, and the like. As a pretreatment for the electrochemical graining, etching may be conducted with caustic soda.

If electrochemical graining is conducted, it is preferably with an alternating current in an aqueous solution mainly composed of hydrochloric acid or nitric acid. The electrochemical graining will be further described hereinafter.

First, the aluminum plate is etched with an alkali. Preferred examples of alkaline agents include caustic soda, caustic potash, sodium metasilicate, sodium carbonate, sodium aluminate, and sodium gluconate. The concentration of the alkaline agent, the temperature of the alkaline agent and the etching time are preferably selected from 0.01 to 20%, 20° to 90° C. and 5 sec. to 5 min., respectively. The preferred etching rate is in the range of 0.1 to 10 $g/m^2$.

In particular, if the support contains a large amount of impurities, the etching rate is preferably in the range of 0.01 to 1 $g/m^2$ (JP-A-1-237197). Since alkali-insoluble substances (smut) are left on the surface of the aluminum plate thus alkali-etched, the aluminum plate may be subsequently desmutted if necessary.

The pretreatment is effected as mentioned above. The aluminum plate is subsequently subjected to AC electrolytic etching in an electrolyte mainly composed of hydrochloric acid or nitric acid. The frequency of the AC electrolytic current is in the range of 0.1 to 100 Hz, preferably 0.1 to 1.0 Hz or 10 to 60 Hz.

The concentration of the etching solution is in the range of 3 to 150 g/l, preferably 5 to 50 g/l. The solubility of aluminum in the etching bath is preferably in the range of not more than 50 g/l, more preferably 2 to 20 g/l. The etching bath may contain additives as necessary. However, in mass production, it is difficult to control the concentration of such an etching bath.

The electric current density in the etching bath is preferably in the range of 5 to 100 A/dm$^2$, more preferably 10 to 80 A/dm$^2$. The waveform of electric current can be properly selected depending on the required quality and the components of aluminum support used but may be preferably a special alternating waveform as described in JP-B-56-19280 and JP-B-55-19191 (The term "JP-B" as used herein means an "examined Japanese patent publication"). The waveform of electric current and the liquid conditions are properly selected depending on required electricity as well as required quality and components of aluminum support used.

The aluminum plate which has been subjected to electrolytic graining is then subjected to dipping in an alkaline solution as a part of desmutting treatment to dissolve smutts away. As such an alkaline agent, there may be used caustic soda or the like. The desmutting treatment is preferably effected at a pH value of not lower than 10 and a temperature of 25° to 60° C. for a dipping time as extremely short as 1 to 10 seconds.

The aluminum plate thus etched is then dipped in a solution mainly composed of sulfuric acid. It is preferred that the sulfuric acid solution is in the concentration range of 50 to 400 g/l and the temperature range of 25° to 65° C. If the concentration of sulfuric acid is more than 400 g/l or the temperature of sulfuric acid is more than 65° C., the layer to be treated is more liable to corrosion, and in an aluminum alloy comprising not less than 0.3% of manganese, the grains formed by the electrochemical graining treatment is collapsed. Further, if the aluminum plate is etched by more than 0.2 g/m$^2$, the press life of the printing plate is reduced. Thus, the etching rate is preferably controlled to not more than 0.2 g/m$^2$. The aluminum plate preferably forms an anodized film thereon in an amount of 0.1 to 10 g/m$^2$, more preferably 0.3 to 5 g/m$^2$.

The anodizing conditions vary with the electrolyte used and thus are not specifically determined. In general, it is appropriate that the electrolyte concentration is in the range of 1 to 80% by weight, the electrolyte temperature is in the range of 5° to 70° C., the electric current density is in the range of 0.5 to 60 A/cm$^2$, the voltage is in the range of 1 to 100 V, and the electrolysis time is in the range of 1 second to 5 minutes.

The grained aluminum plate having an anodized film thus obtained is stable and excellent in hydrophilicity itself and thus can directly form a photosensitive coat thereon. If necessary, the aluminum plate may be further subjected to surface treatment. For example, a silicate layer formed by the foregoing metasilicate of alkaline metal or an undercoating layer formed by a hydrophilic high molecular compound may be formed on the aluminum plate. The coating weight of the undercoating layer is preferably in the range of 5 to 150 mg/m$^2$.

A photosensitive coat is then formed on the aluminum plate thus treated. The photosensitive printing plate is imagewise exposed to light, and then developed to make a printing plate, which is then mounted in a printing machine for printing.

Since an inner type planographic printing plate has a photosensitive layer mainly composed of high molecular compound, the printing plate which has been developed is then subjected to burning at an elevated temperature to provide a marked improvement in its abrasion resistance. The heating temperature is normally not lower than 200° C.

The present invention will be further described in the following non-limiting examples.

EXAMPLES 1 AND 2 AND COMPARATIVE EXAMPLES 1 TO 4

Figure 2A:
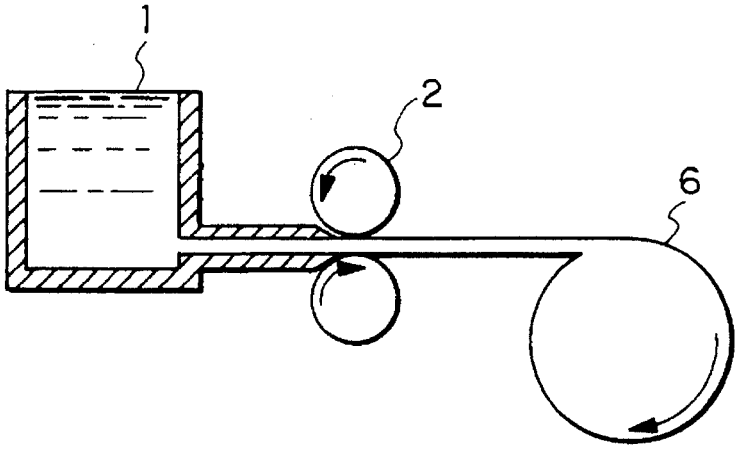
FIG. 2(A), 2(B), 2(C) and 2(D) illustrate the process for the preparation of the support for planographic printing plate according to the present invention, in which 1 indicates a melting furnace, 2 indicates a twin-roll continuous casting machine, 3 indicates a cold rolling mill, 4 indicates a heat treatment apparatus, 5 indicates a reformer, and 6 indicates a coiler.
Figure 2B:
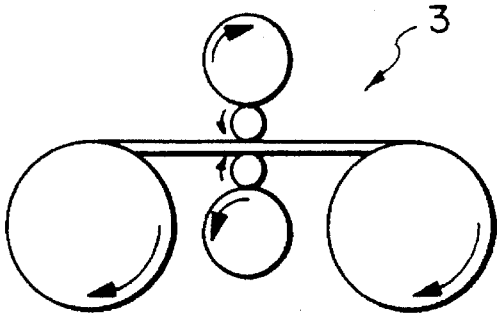
Figure 2C:
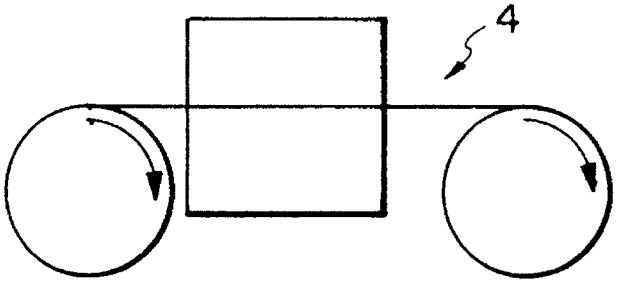
Figure 2D:
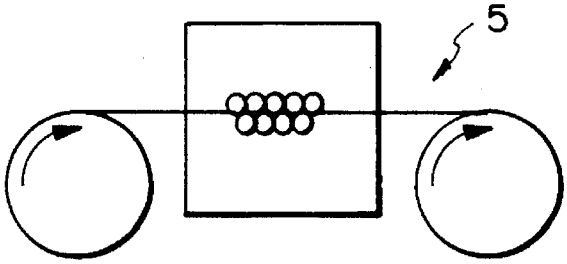

Molten aluminum alloy having a variety of compositions as set forth in Table 1 were subjected to casting by twin-roll continuous casting machine 2 (as shown in FIG. 2(A)) to prepare 7-mm thick aluminum plates. These aluminum plates were then cold-rolled by cold press 3 (as shown in FIG. 2(B)) to a thickness of 1 mm. The aluminum plates thus rolled were then annealed by heat treatment apparatus 4 (as shown in FIG. 2(C)) by properly altering the annealing temperature and time. The aluminum plates were cold-rolled to a thickness of 0.3 mm, and then reformed by reformer 5 (as shown in FIG. 2(D)) to prepare aluminum plate materials according to JIS 1050. A cross section of the aluminum plates was buffed to specular finish, etched with a 12% hydrofluoric acid, and then observed for diameter of crystalline grains on the surface of the cross section by a polarizing microscope. From the results of measurement, the average diameter in circle equivalence, the diameter in circle equivalence (distribution), and the shape factor were calculated. The measurement range was adjusted such that the number of 50 or more crystalline grains can be observed for the average diameter in circle equivalence, etc.

The aluminum plates thus prepared were used as supports for planographic printing plate. These supports were etched with a 15% aqueous caustic soda solution at a temperature of 50° C. at an etching rate of 6 g/m$^2$, washed with water, desmutted with a 100 g/l sulfuric acid at a temperature of 60° C., and then washed with water.

These supports were then subjected to electrochemical graining with an alternating waveform current as described in JP-B-55-19191 in a 11 g/l nitric acid. The electrolysis conditions were 13 V for anode voltage $V_A$, 11 V for cathode voltage $V_C$, and 290 coulomb/dm$^2$ for anodic electricity. Thereafter, the supports thus grained were desmutted with a 150 g/l sulfuric acid at a temperature of 60° C., and then subjected to anodizing with a 180 g/l sulfuric acid at a temperature of 50° C. to an extent such that the amount of anodized film reached 1.8 g/m$^2$. A photosensitive layer was then coated on the supports. Thereafter, the supports were subjected to burning at a temperature of 280° C. for 10 minutes. The strength of the supports after burning was examined. The surface quality after electrolysis was evaluated as well.

This is because when these photosensitive planographic printing plates are exposed to light through a negative film or positive film, and then developed, (the photosensitive layer is partially removed), and the surface of the substrate itself serves as a non-image or image are on the planographic printing plate, and the surface quality of the substrate itself thus has a great effect on printing properties and visibility of printing plate.

The results of diameter in circle equivalence, shape factor, surface quality and adaptability to burning of the foregoing examples and comparative examples are tabulated below.

TABLE 1

| | % Alloy composition (balance: Al) | | | | Crystalline grain | | | | |
|---|---|---|---|---|---|---|---|---|---|
| | Fe | Si | Cu | Ti | (D) (μm) | Shape factor | Ratio of >40 μm (%) | S.Q. | B.A. |
| Ex. 1: | 0.35 | 0.08 | 0.02 | 0.02 | 20 | 4.90 | 20 | ⊙ | ⊙ |
| Ex. 2: | 0.15 | 0.20 | 0.03 | 0.04 | 19 | 5.60 | 15 | ○ | ⊙ |
| Comp. Ex. 1: | 0.35 | 0.08 | 0.02 | 0.02 | 50 | 4.80 | 60 | Δ | X |
| Comp. Ex. 2: | 0.35 | 0.08 | 0.02 | 0.02 | 30 | 3.40 | 20 | Δ | X |
| Comp. Ex. 3: | 0.35 | 0.08 | 0.02 | 0.02 | 20 | 3.30 | 20 | ○ | X |
| Comp. Ex. 4: | 0.15 | 0.20 | 0.04 | 0.05 | 50 | 4.50 | 60 | X | X |

Notes:
(D) = Diameter in circle equivalence
S.Q. = Surface quality
B.A. = Burning ability
⊙ = Excellent
○ = Good
Δ = Practically available
X = Not available (in B.A., shortage in strength)

The support for planographic printing plate according to the present invention prepared from selected alloy components in a controlled crystalline grain diameter distribution can improve in adaptability to surface treatment such as electrolytic graining and burning adaptability.

While the invention has been described in detail and with reference to specific embodiments thereof, it will be apparent to one skilled in the art that various changes and modifications can be made therein without departing from the spirit and scope thereof.

What is claimed is:

1. A support for planographic printing plate prepared by a process which comprises subjecting molten aluminum alloy to continuous casting by a twin-roll continuous casting machine to directly cast a plate, subjecting the plate to cold rolling and heat treatment once or more times, respectively, reforming the plate, and then surface graining the plate, wherein crystalline grains on a cross section of the finished plate (a) have an average diameter in circle equivalence of 15 μm to 35 μm, (b) contain those having a diameter in circle equivalence of not less than 40 μm in a proportion of not more than 30% and (c) assume a shape factor of not less than 4.0.

2. The support for planographic printing plate according to claim 1, wherein said molten aluminum alloy consists of 0.2 to 0.4 wt % of Fe, 0.05 to 0.20 wt % of Si, not more than 0.03 wt % of Cu, not more than 0.04 wt % of Ti based on the total amount of said molten aluminum alloy, and a balance of aluminum and unavoidable impurities.

3. The support for planographic printing plate according to claim 1, wherein crystalline grains on a cross section of the finished plate have an average diameter in circle equivalence of 15 μm to 30 μm.

4. The support for planographic printing plate according to claim 1, wherein crystalline grains on a cross section of the finished plate have an average diameter in circle equivalence of 17 μm to 22 μm.

5. The support for planographic printing plate according to claim 1, wherein crystalline grains on a cross section of the finished plate contain those having an average diameter in circle equivalence of not less than 40 μm in a proportion of 10% to 25%.

6. The support for planographic printing plate according to claim 1, wherein crystalline grains on a cross section of the finished plate contain those having an average diameter in circle equivalence of not less than 40 μm in a proportion of 15% to 20%.

7. The support for planographic printing plate according to claim 1, wherein crystalline grains on a cross section of the finished plate assume a shape factor of not less than 4.4.

8. The support for planographic printing plate according to claim 1, wherein crystalline grains on a cross section of the finished plate assume a shape factor of not less than 4.8.

* * * * *